US011787187B2

(12) United States Patent
Tani

(10) Patent No.: US 11,787,187 B2
(45) Date of Patent: Oct. 17, 2023

(54) PRINTING APPARATUS

(71) Applicant: FUNAI ELECTRIC CO., LTD., Osaka (JP)

(72) Inventor: Toshiro Tani, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 22 days.

(21) Appl. No.: 17/745,886

(22) Filed: May 17, 2022

(65) Prior Publication Data

US 2022/0396075 A1 Dec. 15, 2022

(30) Foreign Application Priority Data

Jun. 9, 2021 (JP) ..... 2021-096257

(51) Int. Cl.
*B41J 2/165* (2006.01)

(52) U.S. Cl.
CPC ..... *B41J 2/16544* (2013.01); *B41J 2/16526* (2013.01)

(58) Field of Classification Search
CPC .. B41J 2/165; B41J 2/1721; B41J 2002/1742; B41J 2/16535; B41J 2/16541
See application file for complete search history.

(56) References Cited

U.S. PATENT DOCUMENTS

2010/0002048 A1 1/2010 Masaoka
2021/0213734 A1* 7/2021 Martin ..... B29C 64/35

FOREIGN PATENT DOCUMENTS

JP 2010030273 2/2010

* cited by examiner

*Primary Examiner* — Julian D Huffman
(74) *Attorney, Agent, or Firm* — JCIPRNET

(57) ABSTRACT

A printing apparatus includes: a recording head, discharging ink to a recording medium; a roller, having an outer circumferential surface provided for ink idly discharged from the recording head to be attached; a motor, rotating the roller in a predetermined direction; and a scraper, provided to scrape off the ink attached to the outer circumferential surface of the roller in a state in which the roller rotates in the predetermined direction. The scraper has: a recessed surface making surface contact with the outer circumferential surface of the roller; and a notch part formed at an end of the recessed surface, making line contact with the outer circumferential surface of the roller, and recessed in a substantially shape along a rotation direction of the roller and from the end of the recessed surface toward another end.

4 Claims, 11 Drawing Sheets

PRINTING APPARATUS

CROSS-REFERENCE TO RELATED APPLICATION

This application claims the priority benefit of Japan application serial no. 2021-096257 filed on Jun. 9, 2021. The entirety of the above-mentioned patent application is hereby incorporated by reference herein and made a part of this specification.

BACKGROUND

Technical Field

The invention relates to a printing apparatus performing printing on a recording medium.

Description of Related Art

In order to prevent ink clogging in a recording head, an inkjet printing apparatus performs a maintenance operation in which ink is idly discharged from the recording head.

Such printing apparatus includes a maintenance unit for collecting the ink idly discharged from the recording head (see, for example, Patent Document 1).

The maintenance unit has a roller provided below the recording head, a motor rotating the roller in a predetermined direction, and a scraper which is sheet-like and a tip of which linearly contacts the outer circumferential surface of the roller. In a state in which the roller rotates in the predetermined direction, the recording head idly discharges the ink toward the outer circumferential surface of the roller. The ink idly discharged from the recording head is attached to the outer circumferential surface of the roller. Through the rotation of the roller in the predetermined direction, when the ink attached to the outer circumferential surface of the roller arrives at the tip of the scraper, the ink is scraped off by the tip of the scraper. The ink that is scraped off drops from the outer circumferential surface of the roller, and is collected in a waste ink container provided below the roller.

[Prior Art Document]

[Patent Document]

[Patent Document 1] Japanese Laid-Open No. 2010-30273

In the printing apparatus, a pigment ink may be used as the ink for printing. In general, pigment ink is highly viscous and easily curable. When such pigment ink is used, the ink (pigment ink) scraped off from the outer circumferential surface of the roller does not drop from the outer circumferential surface of the roller, but is attached to and accumulates on the side surface of the scraper. When the ink accumulates and piles up on the side surface of the scraper, the ink that piles up overflows to the top of the roller and is attached to the recording head, which leads to the concern of causing printing defects.

SUMMARY

A printing apparatus according to an aspect of the invention is a printing apparatus performing printing on a recording medium. The printing apparatus includes: a recording head, discharging ink to the recording medium; a roller, configured to collect ink which is idly discharged from the recording head and does not contribute to the printing on the recording medium, and having an outer circumferential surface configured for the ink idly discharged from the recording head to be attached; a drive source, rotating the roller in a predetermined direction; and a scraper, configured to scrape off the ink attached to the outer circumferential surface of the roller in a state in which the roller rotates in the predetermined direction. The scraper is provided with: a recessed surface, making surface contact with the outer circumferential surface of the roller; and a notch part, formed at an end of the recessed surface, making line contact with the outer circumferential surface of the roller, and recessed in a substantially V shape along a rotation direction of the roller and from the end of the recessed surface toward another end.

DESCRIPTION OF THE EMBODIMENTS

Figure 1:
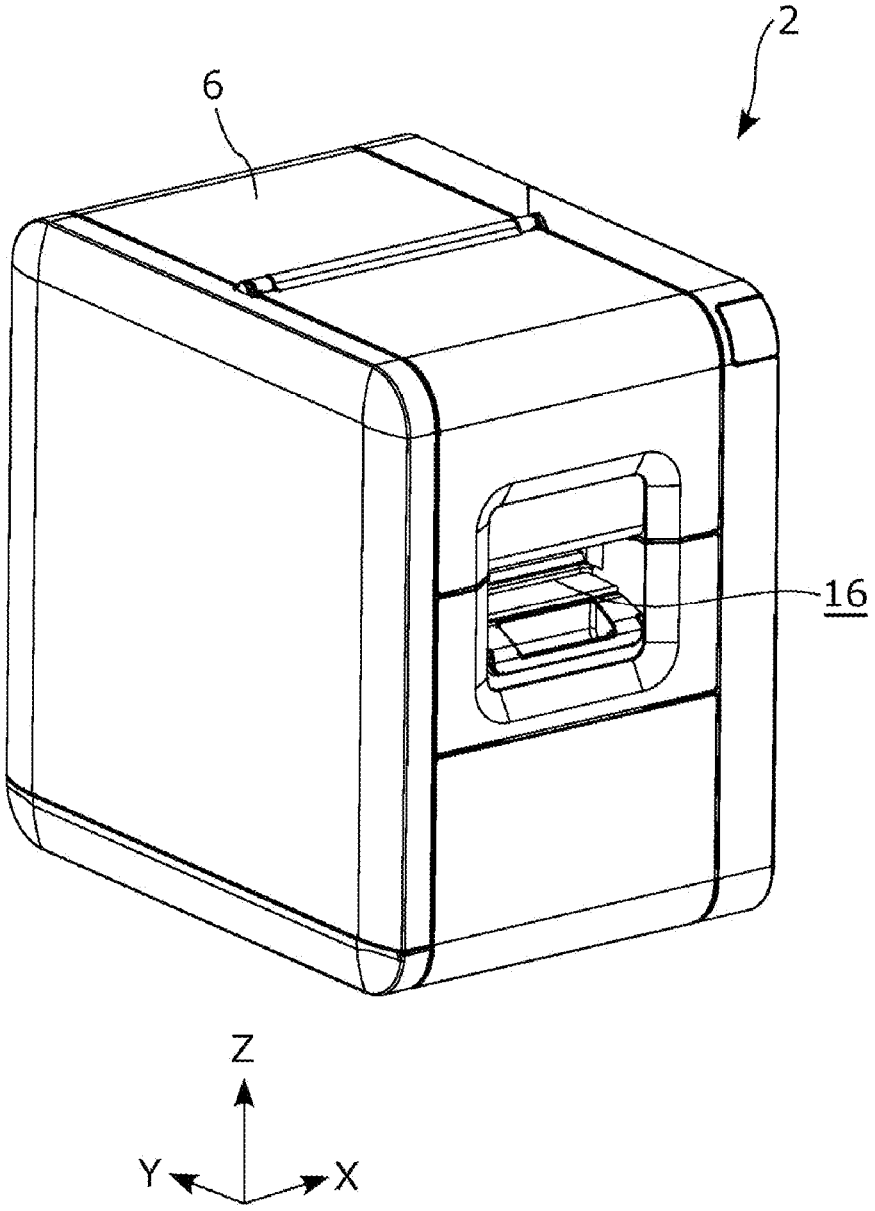
FIG. 1 is a perspective view illustrating an appearance of a printing apparatus according to an embodiment.

In order to achieve the objective, a printing apparatus according to an aspect of the invention is a printing apparatus performing printing on a recording medium. The printing apparatus includes: a recording head, discharging ink to the recording medium; a roller, configured to collect ink which is idly discharged from the recording head and does not contribute to the printing on the recording medium, and having an outer circumferential surface configured for the ink idly discharged from the recording head to be attached; a drive source, rotating the roller in a predetermined direction; and a scraper, configured to scrape off the ink attached to the outer circumferential surface of the roller in a state in which the roller rotates in the predetermined direction. The scraper is provided with: a recessed surface, making surface contact with the outer circumferential surface of the roller; and a notch part, formed at an end of the recessed surface, making line contact with the outer circumferential surface of the roller, and recessed in a substantially V shape along a rotation direction of the roller and from the end of the recessed surface toward another end.

According to the aspect, the notch part of the scraper is formed at the end of the recessed surface, and has a shape recessed in the substantially V shape along the rotation direction of the roller and from the end of the recessed surface toward the another end. In the state in which the roller rotates in the predetermined direction, the ink attached to the outer circumferential surface of the roller is scraped off by the notch part of the scraper. The predetermined direction refers to a direction in which the ink attached to the outer circumferential surface of the roller is scraped off by the scraper along the rotation direction of the roller. At this time, while being sequentially scraped off from the two ends of the notch part in the substantially V shape to the central part, the ink attached to the outer circumferential surface of the roller is collected at the central part of the notch part and then drops due to the own weight of the ink. Accordingly, by suppressing the ink scraped off from the outer circumferential surface of the roller from accumulating at the scraper, the ink can be suppressed from attaching to the recording head.

For example, in the printing apparatus according to an aspect of the invention, the recessed surface may make surface contact with the outer circumferential surface of the roller throughout an end of the roller in an axial direction to another end. In addition, the notch part may include: a first edge part, extending from the end of the roller in the axial direction toward a central part and from the end of the recessed surface toward the another end; and a second edge part, extending from the another end of the roller in the axial direction toward the central part and from the end of the recessed surface toward the another end.

According to the aspect, the first edge part and the second edge part of the notch part formed in the substantially V shape throughout the end to the another end in the axial direction of the roller can make line contact three-dimensionally with the outer circumferential surface of the roller. Accordingly, the ink attached to the outer circumferential surface of the roller can be effectively scraped off.

For example, in the printing apparatus according to an aspect of the invention, the scraper may be configured to be further provided with a suspended surface suspended from the notch part.

According to the aspect, while being sequentially scraped off from the two ends of the notch part in the substantially V shape to the central part, the ink attached to the outer circumferential surface of the roller is collected at the central part of the notch part and then dammed by the suspended surface. The ink dammed by the suspended surface drops from the suspended surface due to the own weight of the ink. Accordingly, the ink attached to the outer circumferential surface of the roller can drop effectively.

According to the printing apparatus according to an aspect of the invention, the ink scraped off from the outer circumferential surface of the roller can be suppressed from attaching to the recording head.

In the following, the embodiments of the invention will be described in detail with reference to the drawings. The embodiments described below are all inclusive or specific examples. The values, shapes, materials, components, positions where the components are provided, and connection configurations shown in the following embodiments are merely examples, and shall not be construed as limitations on the invention. In addition, among the components in the following embodiments, the components not described in the independent claims are described as arbitrary components.

(Embodiment)

[1. Outline of Printing Apparatus]

Figure 2:
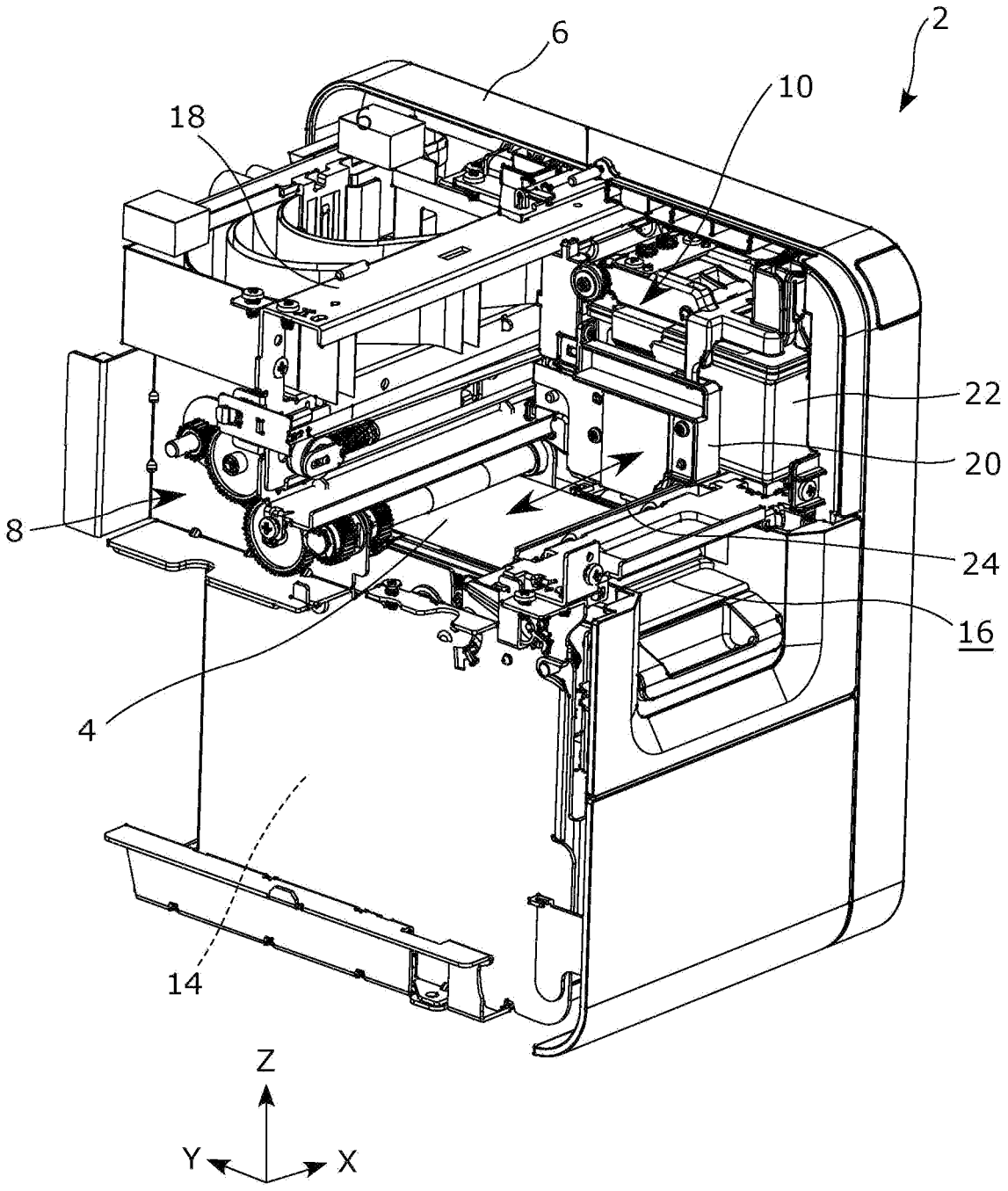
FIG. 2 is a perspective view illustrating an internal mechanism of the printing apparatus according to the embodiment.
Figure 3:
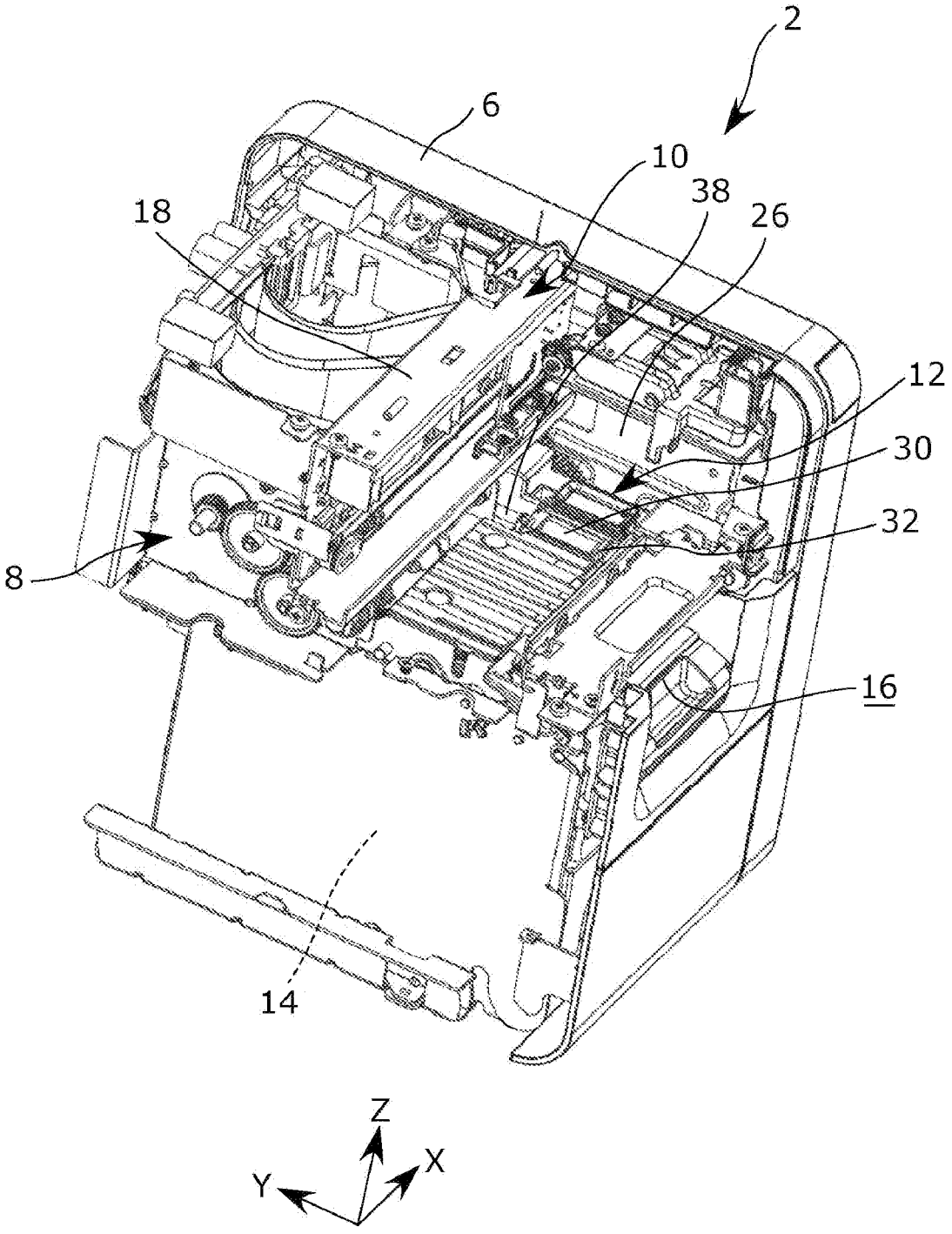
FIG. 3 is a perspective view illustrating the internal mechanism of the printing apparatus according to the embodiment in a state in which a carriage, etc., is omitted.

Firstly, a printing apparatus 2 of the embodiment is outlined with reference to FIGS. 1 to 3. FIG. 1 is a perspective view illustrating an appearance of the printing apparatus 2 according to an embodiment. FIG. 2 is a perspective view illustrating an internal mechanism of the printing apparatus 2 according to the embodiment. FIG. 3 is a perspective view illustrating the internal mechanism of the printing apparatus 2 according to the embodiment in a state in which a carriage 20, etc., is omitted.

In FIGS. 1 to 3, the left-right direction of the printing apparatus 2 is set as X-axis direction, the front-rear direction of the printing apparatus 2 is set as Y-axis direction, and the upper-lower direction of the printing apparatus 2 is set as Z-axis direction.

The printing apparatus 2 is an inkjet printing apparatus serving to perform printing by discharging ink to a recording medium 4. In the embodiment, the printing apparatus 2 is a so-called coupon printer for printing a coupon. The recording medium 4 is a roll paper wound like a roll, for example.

As shown in FIGS. 1 to 3, the printing apparatus 2 includes a housing 6, a conveyance unit 8, a print unit 10, and a maintenance unit 12.

An accommodation part 14 for accommodating the recording medium 4 wound like a roll is provided inside the housing 6. As shown in FIG. 1, a discharge port 16 for discharging the recording medium 4 printed by the print unit 10 outside the housing 6 is provided. The recording medium 4 printed by the print unit 10 is discharged from the discharge port 16 in a state of being cut to a predetermined length, and is used as a coupon.

As shown in FIG. 2, the conveyance unit 8 is a unit for conveying the recording medium 4 and provided inside the housing 6. The conveyance unit 8 conveys the recording medium 4 unwound from the accommodation part 14 in a direction from the accommodation part 14 toward the discharge port 16 (minus Y-axis direction).

As shown in FIG. 2, the print unit 10 is a unit for printing the recording medium 4, and is provided inside the housing 6. As shown in FIG. 2, the print unit 10 has a guide frame 18 and a carriage 20 movably supported by the guide frame 18. The guide frame 18 extends along the left-right direction (X-axis direction) of the printing apparatus 2. The carriage 20 is reciprocally movable in a direction (X-axis direction) substantially perpendicular to the conveyance direction (Y-axis direction) of the recording medium 4.

An ink tank 22 and a recording head 24 are mounted in the carriage 20. The ink tank 22 is filled with four types of ink of CMYK (C: Cyan, M: Magenta, Y: Yellow, K: Black), for example. In addition, the ink filled in the ink tank 22 is pigment ink containing pigment as coloring agents. The recording head 24 is provided at the lower end of the carriage 20, and discharges mist-like ink of each color downward (minus Z-axis side) from the ink tank 22.

During execution of printing, the conveyance unit 8 conveys the recording medium 4 to from the accommodation part 14 to the discharge port 16, and the carriage 20 of the print unit 10 moves reciprocally along the guide frame 18. In such state, with the recording head 24 discharging ink toward the recording medium 4, the recording medium 4 is printed.

In addition, before execution of printing, a maintenance operation is performed to prevent ink clogging in the recording head 24. In the maintenance operation, the carriage 20 stops at a maintenance position (the position of the carriage 20 shown in FIG. 2) located at an end of a reciprocal movement range. The maintenance position is a position right above a roller 30 (to be described afterwards) of the maintenance unit 12. In such state, the recording head 24 idly discharges ink toward the roller 30 of the maintenance unit 12. Here, "idly discharging ink" refers to discharging ink for maintenance, which does not contribute to the printing on the recording medium 4.

As shown in FIG. 3, the maintenance unit 12 is a unit for collecting the ink idly discharged from the recording head 24, and is provided inside the housing 6. More specifically, the maintenance unit 12 is provided at a position adjacent to a conveyance path of the recording medium in the left-right direction of the printing apparatus 2. The configuration of the maintenance unit 12 is described in the following.

[2. Configuration of Maintenance Unit]

Figure 4:
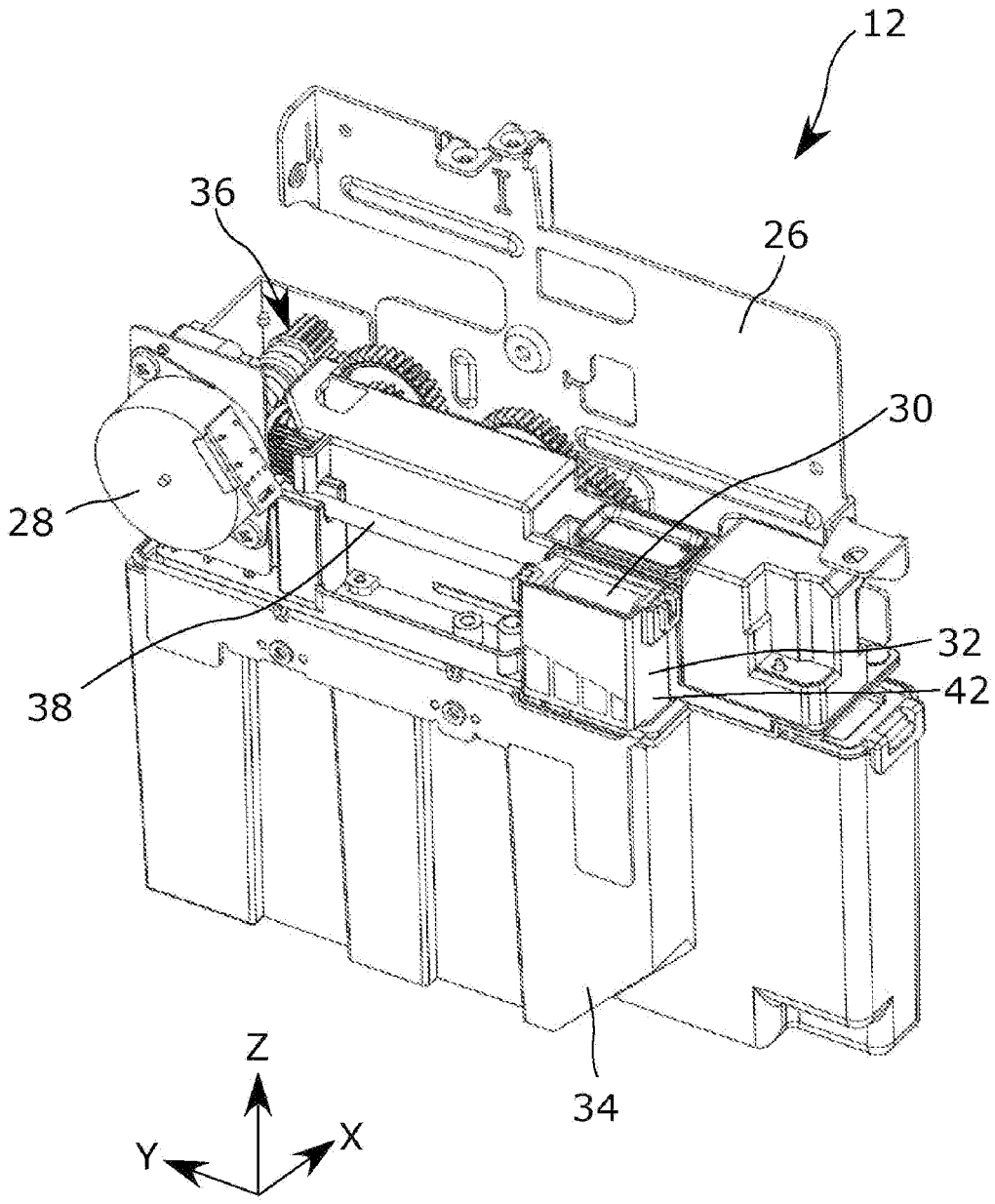
FIG. 4 is a perspective view illustrating a maintenance unit according to the embodiment.
Figure 5:
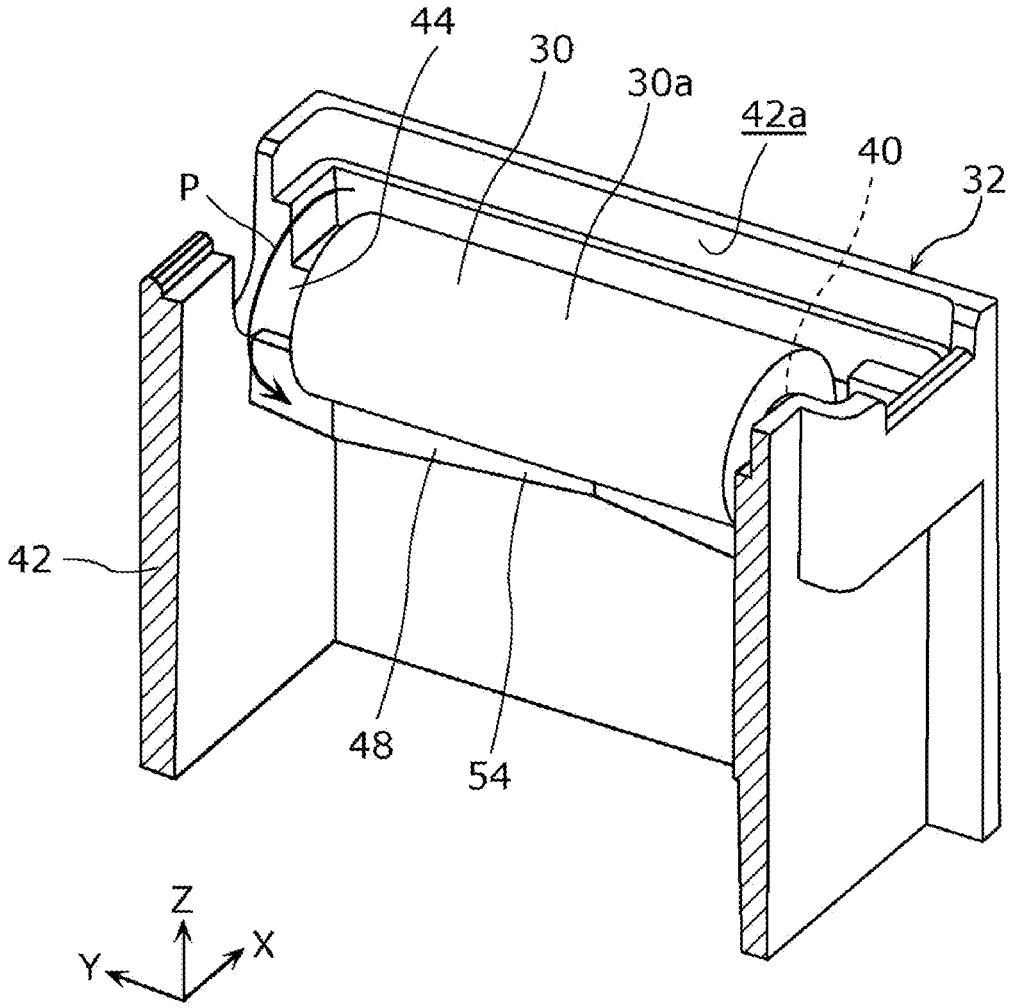
FIG. 5 is a perspective view illustrating a roller and a guide member of the maintenance unit according to the embodiment.
Figure 6:
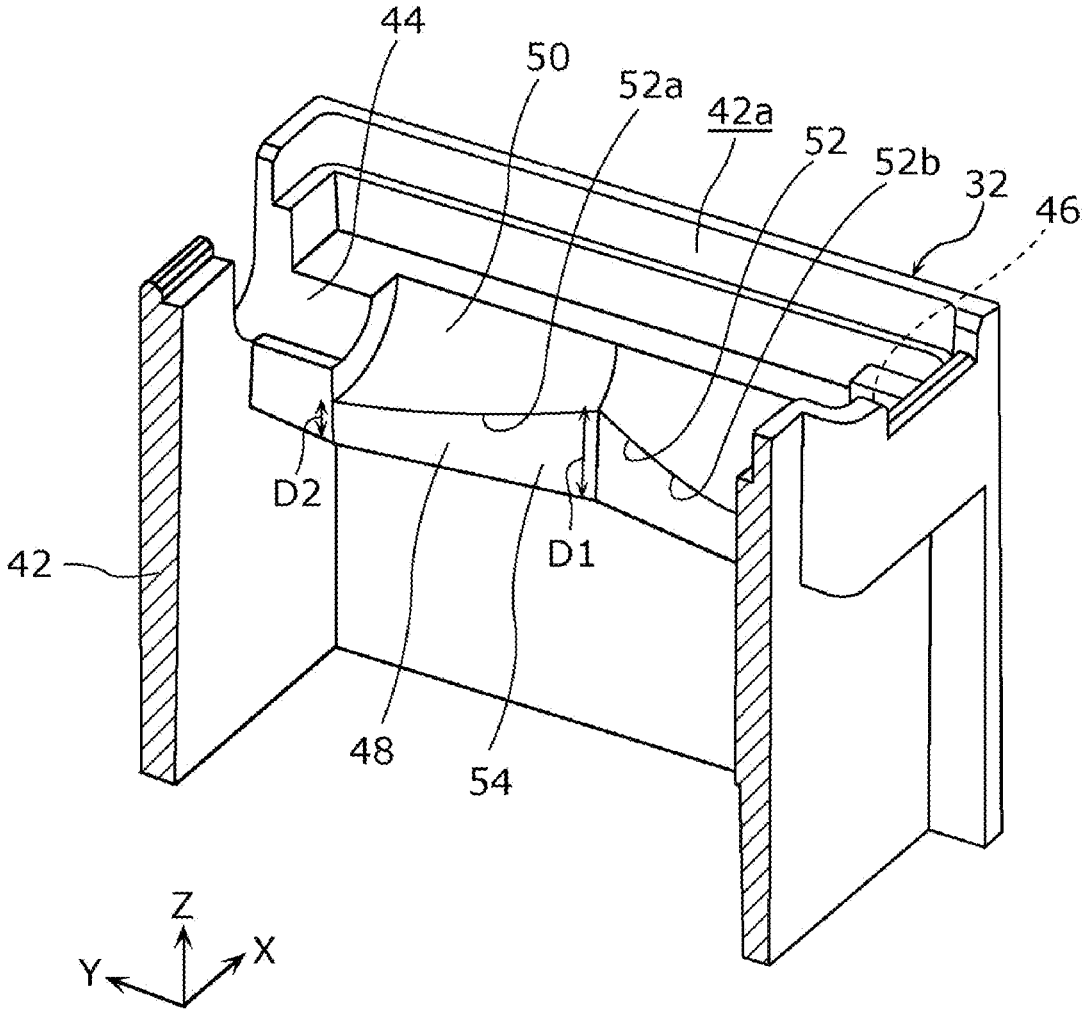
FIG. 6 is a perspective view illustrating the guide member according to the embodiment in a state in which the roller is omitted.
Figure 7:
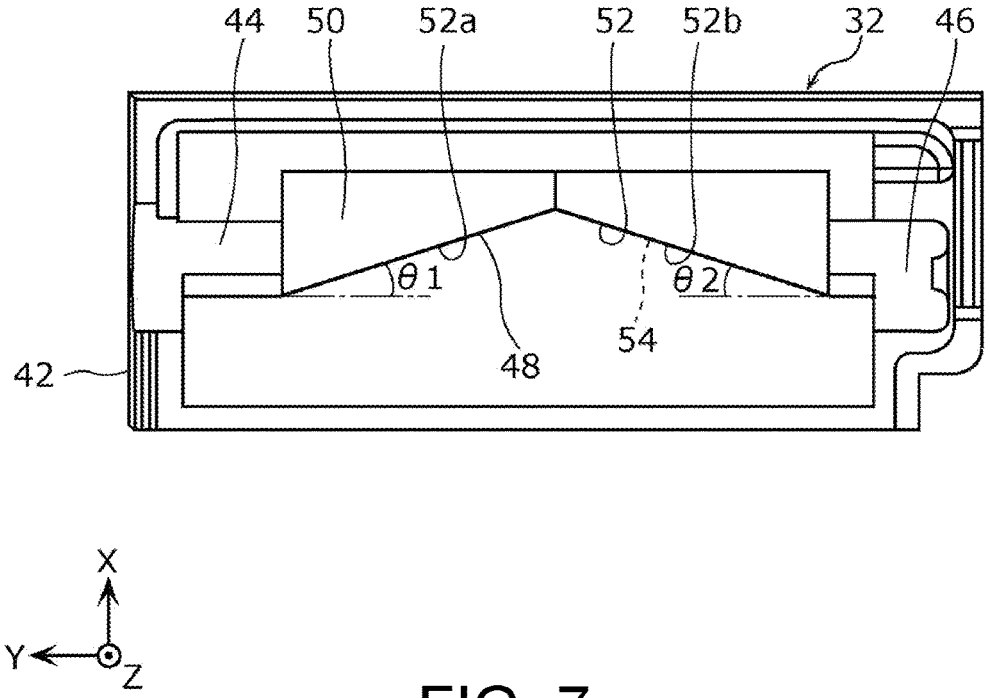
FIG. 7 is a plan view illustrating the guide member according to the embodiment in the state in which the roller is omitted.
Figure 8:
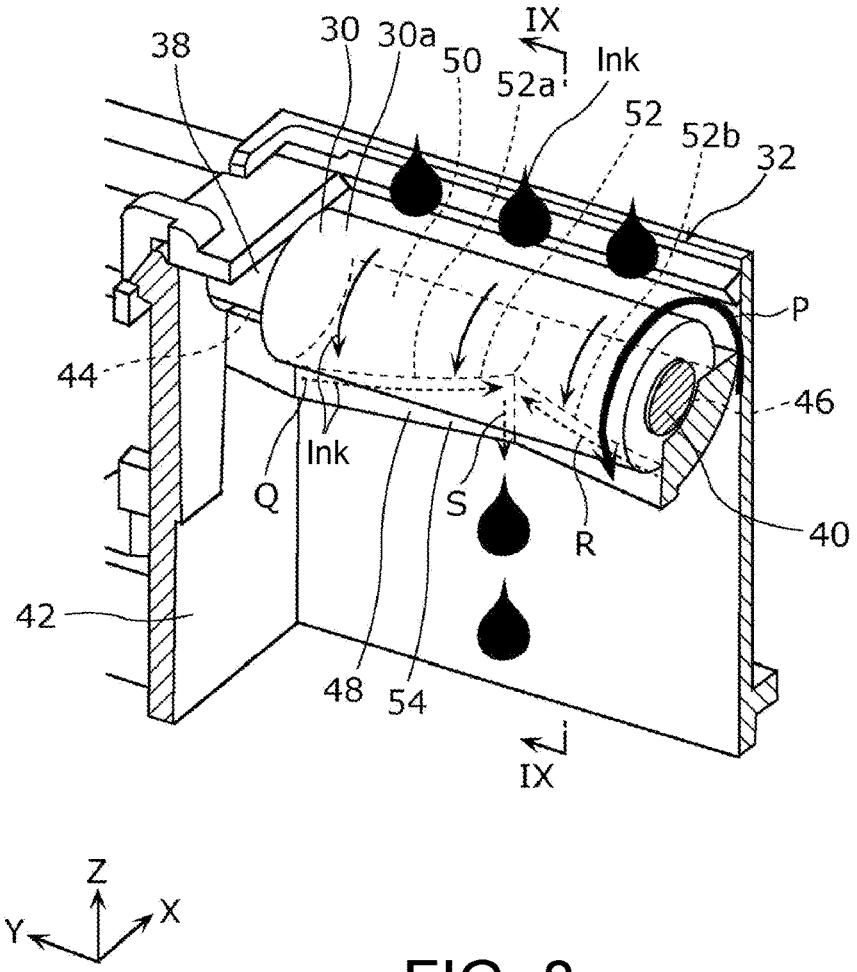
FIG. 8 is a diagram for illustrating an operation of scraping off ink attached to an outer circumferential surface of the roller by a scraper according to the embodiment.
Figure 9:
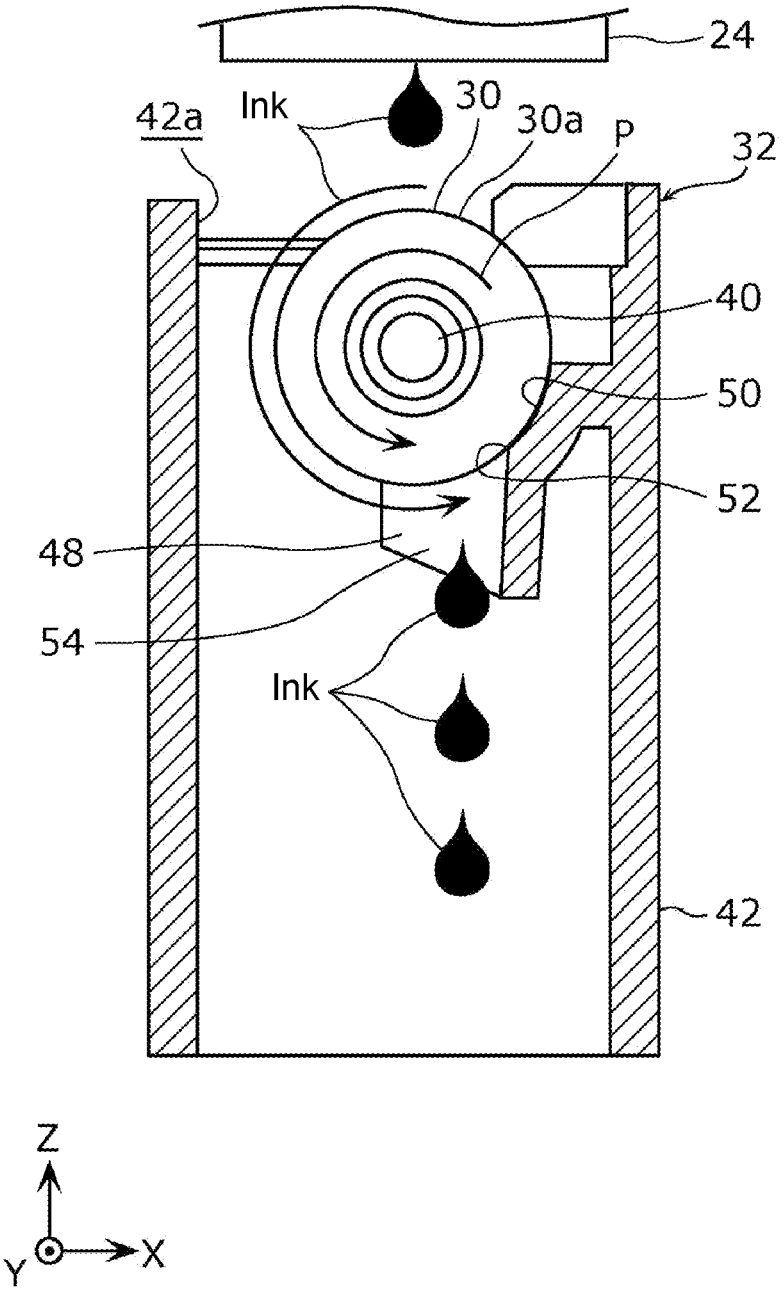
FIG. 9 is a cross-sectional view taken along IX-IX of FIG. 8.

Then, the configuration of the maintenance unit 12 according to the embodiment will be described with reference to FIGS. 4 to 9. FIG. 4 is a perspective view illustrating the maintenance unit 12 according to the embodiment. FIG. 5 is a perspective view illustrating the roller and a guide member 32 of the maintenance unit 12 according to the embodiment. FIG. 6 is a perspective view illustrating the guide member 32 according to the embodiment in a state in which the roller 30 is omitted. FIG. 7 is a plan view illustrating the guide member 32 according to the embodiment in the state in which the roller 30 is omitted. FIG. 8 is a diagram for illustrating an operation of scraping off ink attached to an outer circumferential surface 30*a* of the roller 30 by a scraper 48 according to the embodiment. FIG. 9 is a cross-sectional view taken along IX-IX of FIG. 8.

As shown in FIG. 4, the maintenance unit 12 has a frame 26, a motor 28, the roller 30, the guide member 32, and a waste ink container 34.

The frame 26 supports the motor 28, the guide member 32, and the waste ink container 34, etc. The frame 26 is formed by pressing a sheet metal, for example.

The motor 28 is a drive source for rotating the roller 30. The motor 28 is supported by the frame 26 and connected to the roller 30 via a gear mechanism 36 and a shaft 38. The rotation driving force of the motor 28 is transmitted to the roller 30 via the gear mechanism 36 and the shaft 38.

The roller 30 collects the ink by transmitting the ink idly discharged from the recording head 24 toward the waste ink container 34. When the carriage 20 stops at the maintenance position, the roller 30 is provided right below the carriage 20. As shown in FIGS. 4 and 5, the roller 30 is rotatably supported by the guide member 32. The roller 30 is formed in a cylindrical columnar shape, and has the outer circumferential surface 30*a* for being attached to by the ink idly discharged from the recording head 24. The roller 30 is formed by resin, such as polyacetal (POM), for example. In addition, the length of the roller 30 in the axial direction (Y-axis direction) is 12 mm, for example, and the diameter of the roller 30 is 8 mm, for example.

An end of the roller 30 in the axial direction is connected with the shaft 38 (see FIGS. 4 and 8). In addition, a shaft part 40 protruding outward in the axial direction is formed at the other end of the roller 30 in the axial direction. By transmitting the rotation driving force from the motor 28 to the roller 30, the roller 30 rotates in a predetermined direction (a direction indicated by an arrow P in FIGS. 5, 8, and 9). The predetermined direction refers to a direction in which the ink attached to the outer circumferential surface 30*a* of the roller 30 is scraped off by the scraper 48 (to be described afterwards) along the rotation direction of the roller 30.

As shown in FIGS. 5 to 7, the guide member 32 has a tubular part 42, a pair of support parts 44 and 46, and the scraper 48. The guide member 32 is integrally formed by resin, such as POM, for example.

The tubular part 42 guides the ink scraped off by the scraper 48 from the outer circumferential surface 30*a* of the roller 30 to the waste ink container 34. As shown in FIG. 4, the tubular part 42 is formed in a substantially rectangular tubular shape, and the axial direction of the tubular part 42 extends in the upper-lower direction (Z-axis direction). As shown in FIG. 5, the roller 30 is provided at an opening part 42*a* on the upper end side of the tubular part 42. In addition, an opening part (not shown) on the lower end side of the tubular part 42 is in communication with the waste ink container 34. For the ease of description, a portion of the tubular part 42 is cut out and not shown in FIGS. 5, 6, and 8.

As shown in FIGS. 6 and 7, the pair of support parts 44 and 46 are formed on the inner side surface on the upper end side of the tubular part 42, and are provided to be spaced apart in the front-rear direction (Y-axis direction). As shown in FIG. 8, the support part 44 supports the shaft 38 to be rotatable, and the support part 46 supports the shaft part 40 of the roller 30 to be rotatable.

The scraper 48 scrapes off the ink attached to the outer circumferential surface 30*a* of the roller 30. The scraper 48 has a recessed surface 50, a notch part 52, and a suspended surface 54.

As shown in FIGS. 6 and 7, the recessed surface 50 is formed on the inner side surface on the upper end side of the tubular part 42, and is provided between the support part 44 and the support part 46. As shown in FIG. 9, the recessed surface 50 supports the outer circumferential surface 30*a* of the roller 30 to be rotatable by making surface contact with a portion of the outer circumferential surface 30*a* of the roller 30 throughout an end of the roller 30 to the other end in the axial direction.

As shown in FIGS. 6 and 7, the notch part 52 is formed at an end of the recessed surface 50. Here, "an end of the recessed surface 50" refers to the end of the recessed surface 50 on the upstream side in the predetermined direction (the rotation direction of the roller 30), and "the other end of the recessed surface 50" refers to the end of the recessed surface 50 on the downstream side in the predetermined direction. As shown in FIGS. 8 and 9, the notch part 52 makes line contact with the outer circumferential surface 30*a* of the roller 30, and is recessed in a substantially V shape along the rotation direction of the roller 30 and from the end of the recessed surface 50 to the other end of the recessed surface 50. With the notch part 52 being formed in the substantially V shape, the notch part 52 makes line contact three-dimensionally with the outer circumferential surface 30*a* of the roller 30.

In the specification, "substantially V shape" refers to a shape that spreads out from the downstream side toward the upstream side in the predetermined direction. It is not required that each of a first edge part 52*a* and a second edge part 52*b* is a straight line. Each of the first edge part 52*a* and the second edge part 52*b* may also be a curved line. In addition, it is not required that the "substantially V shape" is a shape in left-right symmetry, but may also be a shape in left-right asymmetry.

More specifically, the notch part 52 includes the first edge part 52*a* and the second edge part 52*b*. An end of the first edge part 52*a* and an end of the second edge part 52*b* are connected with each other at the central part of the roller 30 in the axial direction.

The first edge part 52*a* linearly extends from the end of the roller 30 to the central part in the axial direction and from the end of the recessed surface 50 toward the other end (that is, from the upstream side toward the downstream side in the predetermined direction). In the XY plane view shown in FIG. 7, an inclination angle θ1 of the first edge part 52*a* with respect to the axial direction of the roller 30 is, for example, 20°.

The second edge part 52*b* linearly extends from the other end of the roller 30 to the central part in the axial direction and from the end of the recessed surface 50 toward the other end (that is, from the upstream side toward the downstream side in the predetermined direction). In the XY plane view shown in FIG. 7, an inclination angle θ2 of the second edge part 52*b* with respect to the axial direction of the roller 30 is, for example, 20°.

As shown in FIGS. 6 and 7, the suspended surface 54 is a substantially V-shaped surface suspended from the notch part 52 by a predetermined thickness. The predetermined thickness may be 2 to 3 mm. When the predetermined thickness is less than 2 mm, there is a concern that the ink scraped off from the outer circumferential surface 30*a* of the roller 30 may intrude to the back surface side (plus X-axis side). Meanwhile, when the predetermined thickness is more than 3 mm, there is a concern that the ink scraped off from the outer circumferential surface 30*a* of the roller 30 may easily accumulate on the suspended surface 54. In addition, as shown in FIG. 6, a predetermined thickness D1 of the suspended surface 54 corresponding to the central part of the roller 30 in the axial direction is 3 mm, for example, and a predetermined thickness D2 of the suspended surface 54 corresponding to the two ends of the roller 30 in the axial direction is 2 mm, for example. That is, the predetermined thickness of the suspended surface 54 is gradually reduced from the central part to each of the two ends in the axial direction of the roller 30.

In the following, the operation of scraping off the ink attached to the outer circumferential surface 30*a* of the roller 30 by using the scraper 48 is described with reference to FIGS. 8 and 9.

As shown in FIG. 9, the recording head 24 is located right above the roller 30, and, in a state in which the roller 30 rotates in the predetermined direction, the recording head 24 idly discharges ink toward the outer circumferential surface 30*a* of the roller 30. Accordingly, the ink idly discharged from the recording head 24 is attached to the outer circumferential surface 30*a* of the roller 30.

Through the rotation of the roller 30 in the predetermined direction, when the ink attached to the outer circumferential surface 30*a* of the roller 30 arrives at the notch part 52, the ink is scraped off by the notch part 52. Specifically, as shown in an arrow Q in a broken line in FIG. 8, a portion of the ink attached to the outer circumferential surface 30*a* of the roller 30 drops, due to its own weight, from the outer circumferential surface 30*a* of the roller 30, while being scraped off sequentially from the other end of the first edge part 52*a* (an end distant from the second edge part 52*b*) to the end of the first edge part 52*a* (an end close to the second edge part 52*b*). In addition, another portion of the ink attached to the outer circumferential surface 30*a* of the roller 30 is collected at the central part of the notch part 52 (the portion where the end of the first edge part 52*a* and the end of the second edge part 52*b* are connected with each other) while being scraped off sequentially from the other end of the first edge part 52*a* to the end of the first edge part 52*a*.

In addition, as shown in an arrow R in a broken line in FIG. 8, a portion of the ink attached to the outer circumferential surface 30*a* of the roller 30 drops, due to its own weight, from the outer circumferential surface 30*a* of the roller 30, while being scraped off sequentially from the other end of the second edge part 52*b* (an end distant from the first edge part 52*a*) to the end of the second edge part 52*b* (an end close to the first edge part 52*a*). In addition, another portion of the ink attached to the outer circumferential surface 30*a* of the roller 30 is collected at the central part of the notch part 52 while being scraped off sequentially from the other end of the second edge part 52*b* to the end of the second edge part 52*b*.

By doing so, after being collected at the central part from the two ends of the notch part 52, the ink scraped off from the outer circumferential surface 30*a* of the roller 30 is dammed by the suspended surface 54 as shown in FIG. 9. The ink dammed by the suspended surface 54, as indicated by an arrow sign S in a broken line shown in FIG. 8, drops from the suspended surface 54 due to the own weight of the ink, and is collected in the waste ink container 34.

Figure 10:
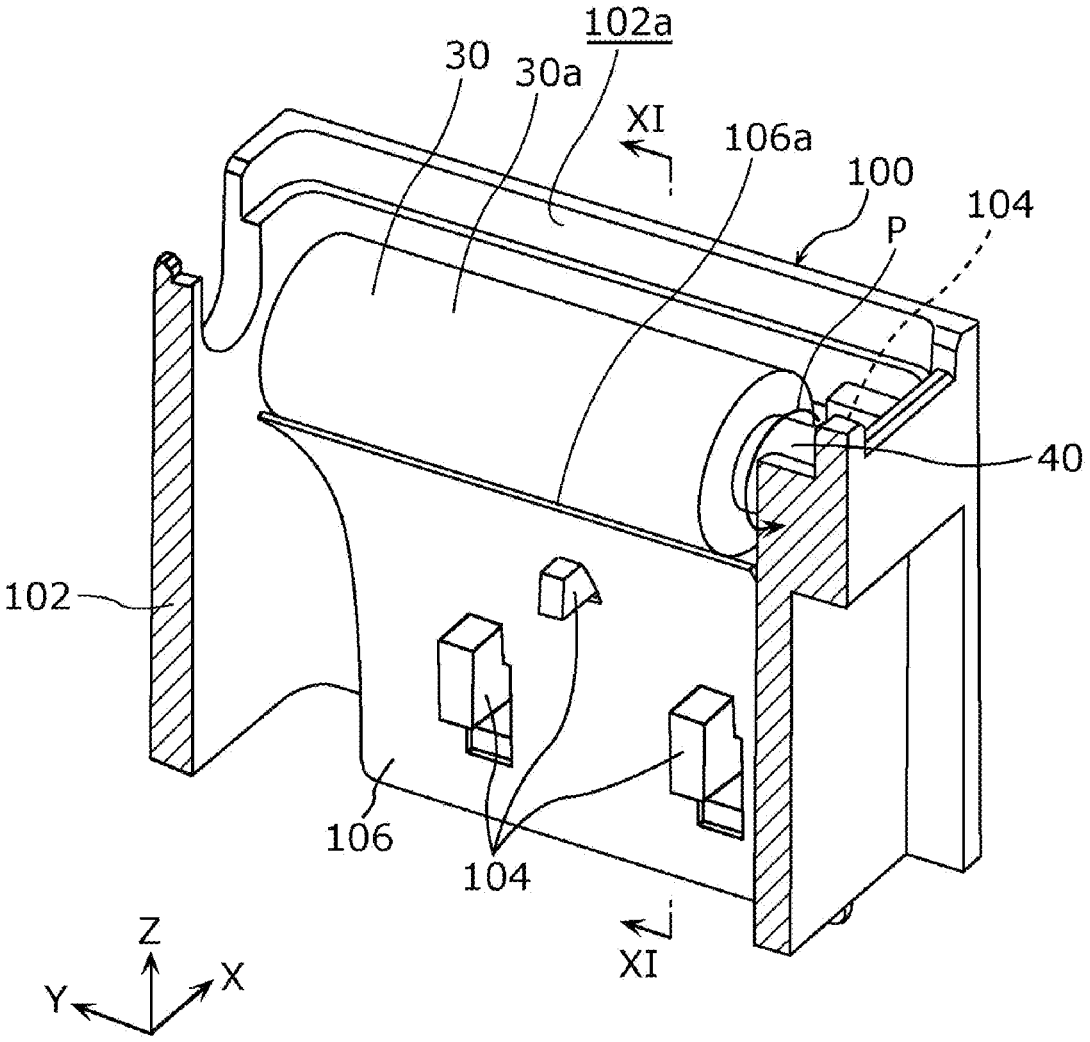
FIG. 10 is a perspective view illustrating a roller and a guide member of a maintenance unit according to a comparative example.
Figure 11:
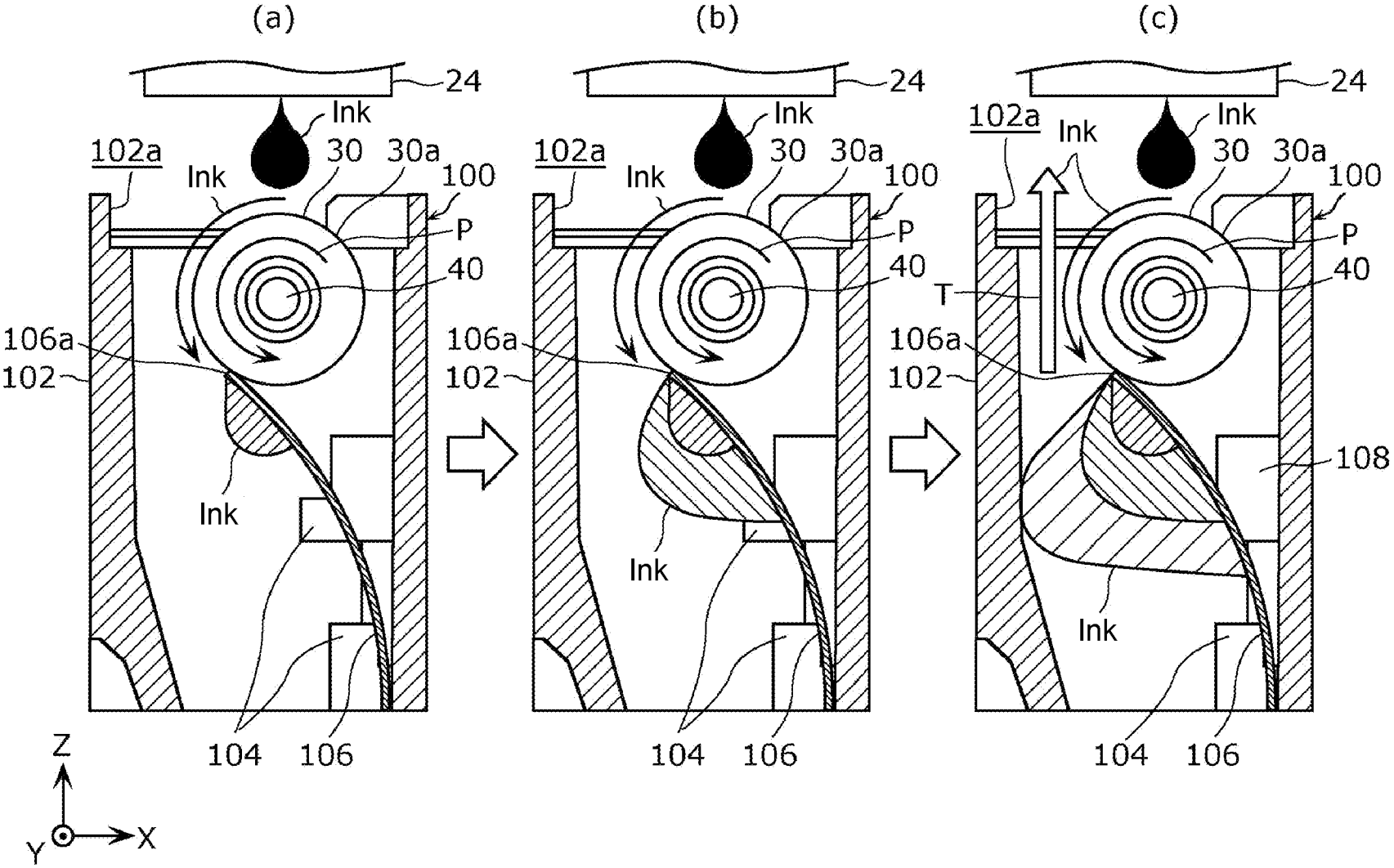
In FIG. 11, (*a*), (*b*), and (*c*) are cross-sectional views taken along XI-XI of FIG. 10.

In the following, the configuration of a maintenance unit according to a comparative example is described with reference to FIGS. 10 and 11. FIG. 10 is a perspective view illustrating the roller 30 and a guide member 100 of the maintenance unit according to a comparative example. In FIG. 11 (a), (b), and (c) are cross-sectional views taken along XI-XI of FIG. 10. In FIGS. 10 and 11, components same as those shown in FIGS. 4 to 9 are labeled with the same reference symbols, and the description thereof is omitted.

As shown in FIG. 10, in the maintenance unit according to the comparative example, the guide member 100 and a scraper 106 are formed separately. Multiple protrusions 104 are formed on the inner side surface of a tubular part 102 of the guide member 100.

The scraper 106 is formed in a sheet shape, and is supported in a bent shape by the protrusions 104 of the tubular part 102. An edge part 106*a* formed at the upper end of the scraper 106 is formed in a linear shape and makes line contact with the outer circumferential surface 30*a* of the roller 30. The scraper 106 is formed by resin, such as polyethylene terephthalate (PET), for example.

As shown in (a) of FIG. 11, the recording head 24 is located right above the roller 30, and, in a state in which the roller 30 rotates in the predetermined direction (the direction indicated by the arrow P shown in (a) of FIG. 11), the recording head 24 idly discharges ink toward the outer circumferential surface 30*a* of the roller 30. Accordingly, the ink idly discharged from the recording head 24 is attached to the outer circumferential surface 30*a* of the roller 30.

Through the rotation of the roller 30 in the predetermined direction, when the ink attached to the outer circumferential surface 30*a* of the roller 30 arrives at the edge part 106*a* of the scraper 106, the ink is scraped off by the edge part 106*a*. At this time, the ink attached to the outer circumferential surface 30*a* of the roller 30 is uniformly scraped off throughout an end of the edge part 106*a* to the other end in the length direction (Y-axis direction). Therefore, as shown in (a) of FIG. 11, the ink scraped off from the outer circumferential surface 30*a* of the roller 30 may be easily attached to and accumulate on the side surface in the vicinity of the upper end of the scraper 106.

Then, when the roller 30 further rotates in the predetermined direction, as shown in (b) of FIG. 11, the ink scraped off from the outer circumferential surface 30*a* of the roller 30 sequentially accumulates on the side surface of the scraper 106.

Then, when the roller 30 further rotates in the predetermined direction, as shown in (c) of FIG. 11, the ink scraped off from the outer circumferential surface 30*a* of the roller 30 accumulates and piles up on the side surface of the scraper 106, and contacts the inner side surface of the tubular part 102. Then, as shown in an arrow T in (c) of FIG. 11, the accumulated ink overflows to the top from the opening 102*a* of the tubular part 102 to attach to the recording head 24, raising the concern of printing defects.

Comparatively, in the printing apparatus 2 according to the embodiment, the notch part 52 of the scraper 48 is formed at the end of the recessed surface 50 on the upstream side in the predetermined direction, and has a recessed shape that is substantially V-shaped from the upstream side toward the downstream side in the predetermined direction. In the state in which the roller 30 rotates in the predetermined direction, the ink attached to the outer circumferential surface 30*a* of the roller 30 is scraped off by the notch part 52 of the scraper 48.

At this time, a portion of the ink attached to the outer circumferential surface 30*a* of the roller 30 drops from the outer circumferential surface 30*a* of the roller 30 due to the own weight of the ink while being sequentially scraped off from the two ends of the notch part 52 in the substantially V shape to the central part. In addition, another portion of the ink attached to the outer circumferential surface 30*a* of the roller 30 is collected at the central part of the notch part 52 and then drops due to the own weight of the ink, while being sequentially scraped off from the two ends of the notch part 52 in the substantially V shape to the central part. Accordingly, by suppressing the ink scraped off from the outer circumferential surface 30*a* of the roller 30 from accumulating at the scraper 48, the ink can be suppressed from attaching to the recording head 24.

(Modified Example 1)

Figure 12:
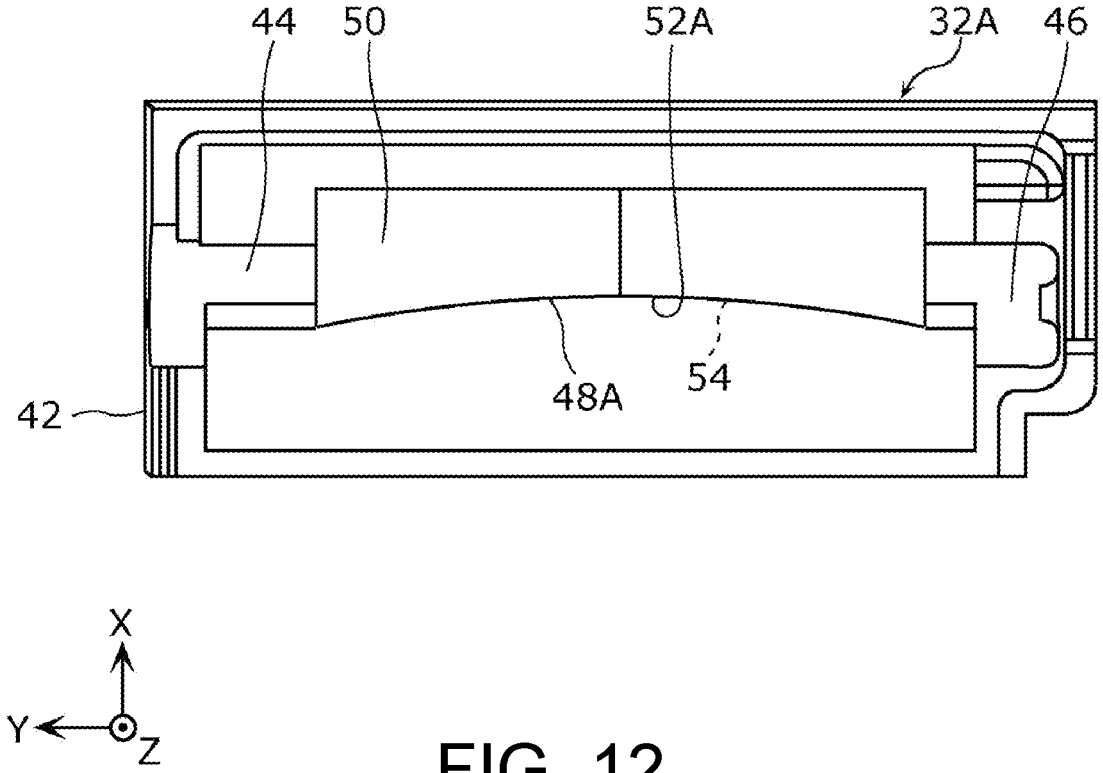
FIG. 12 is a plan view illustrating a guide member according Modified Example 1 in the state in which the roller is omitted.

A guide member 32A according to Modified Example 1 is described with reference to FIG. 12. FIG. 12 is a plan view illustrating the guide member 32A according Modified Example 1 in the state in which the roller 30 is omitted. In the respective modified examples in the following, components same as those of the above embodiment are labeled with the same reference symbols, and the description thereof is omitted.

As shown in FIG. 12, in the guide member 32A according to Modified Example 1, the shape of a scraper 48A is different from the above embodiment. Specifically, in the above embodiment, the notch part 52 of the scraper 48 is formed by a straight line in a substantially V shape. However, in the modified example, a notch part 52A of the scraper 48A is formed by a curved line in a substantially V shape. Even in such configuration, effects same as the above embodiment can still be obtained.

(Modified Example 2)

Figure 13:
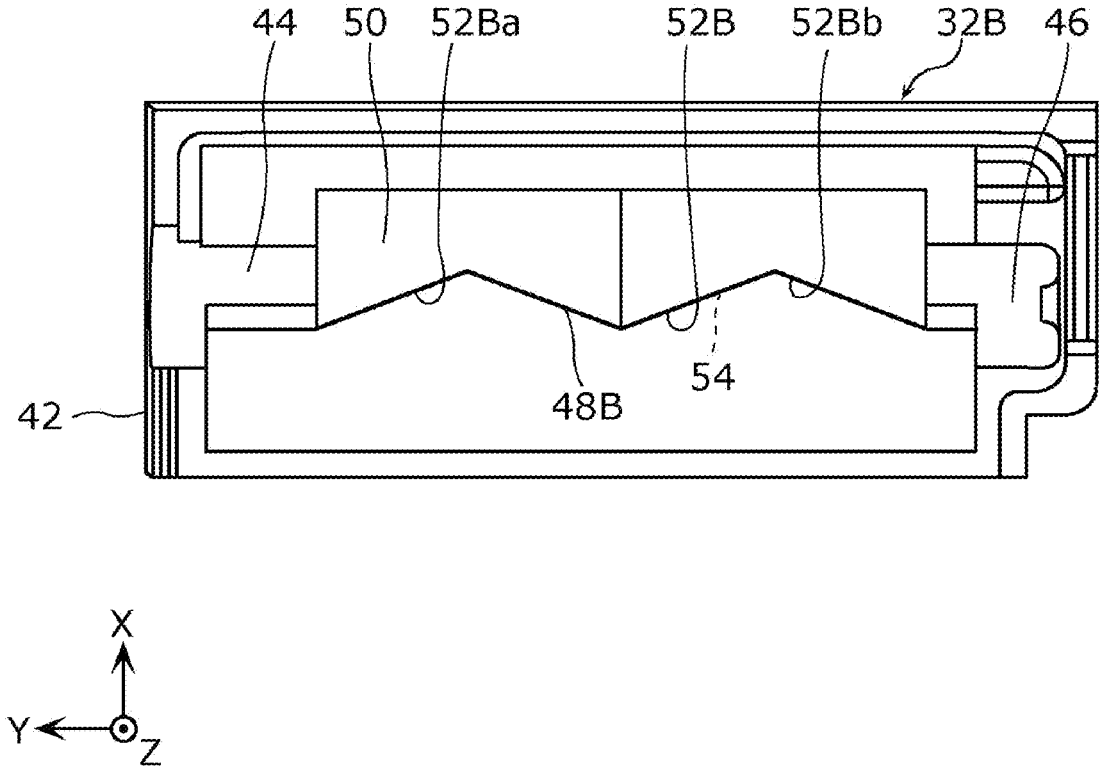
FIG. 13 is a plan view illustrating a guide member according Modified Example 2 in the state in which the roller is omitted.

A guide member 32B according to Modified Example 2 is described with reference to FIG. 13. FIG. 13 is a plan view illustrating the guide member 32B according Modified Example 2 in the state in which the roller 30 is omitted.

As shown in FIG. 13, in the guide member 32B according to Modified Example 2, the shape of a scraper 48B is different from the above embodiment. Specifically, a notch part 52B of the scraper 48B includes a first edge part 52Ba formed by a straight line in a substantially V shape and a second edge part 52Bb formed by a straight line in a substantially V shape. The first edge part 52Ba and the second edge part 52Bb are provided to be adjacent along the axial direction of the roller 30. That is, the notch part 52B is formed, as a whole, in a serrated shape.

Even in such configuration, effects same as the above embodiment can still be obtained.

In the modified example, the notch part 52B includes two edge parts (the first edge part 52Ba and the second edge part 52Bb) in a substantially V shape. However, the invention is not limited thereto, and the notch part may include three or more edge parts in a substantially V shape.

(Other Modified Examples)

The printing apparatus according to the embodiments and the modified examples of the invention have been described above. However, the printing apparatus according to the invention is not limited thereto.

In the above embodiments and examples, the recording medium 4 is a roll paper. However, the invention is not limited thereto. For example, the recording medium 4 may also be a plain paper, a photo paper, or a compact disc read only memory (CD-ROM) having a printable label surface.

[Industrial Applicability]

The printing apparatus according to the embodiment can be suitable as an inkjet printer performing printing by discharging ink to a recording medium, for example.

What is claimed is:

1. A printing apparatus, performing printing on a recording medium, the printing apparatus comprising:

a recording head, discharging ink to the recording medium;

a roller, configured to collect ink which is idly discharged from the recording head and does not contribute to the printing on the recording medium, and having an outer circumferential surface configured for the ink idly discharged from the recording head to be attached;

a drive source, rotating the roller in a predetermined direction; and a scraper, configured to scrape off the ink attached to the outer circumferential surface of the roller in a state in which the roller rotates in the predetermined direction, wherein the scraper is provided with:

a recessed surface, making surface contact with the outer circumferential surface of the roller; and a notch part, formed at an end of the recessed surface, making line contact with the outer circumferential surface of the roller, and recessed in a substantially V shape along a rotation direction of the roller and from the end of the recessed surface toward another end.

2. The printing apparatus as claimed in claim 1, wherein the recessed surface makes surface contact with the outer circumferential surface of the roller throughout an end of the roller in an axial direction to another end, and the notch part comprises:

a first edge part, extending from the end of the roller in the axial direction toward a central part and from the end of the recessed surface toward the another end; and a second edge part, extending from the another end of the roller in the axial direction toward the central part and from the end of the recessed surface toward the another end.

3. The printing apparatus as claimed in claim 2, wherein the scraper is further provided with a suspended surface suspended from the notch part.

4. The printing apparatus as claimed in claim 1, wherein the scraper is further provided with a suspended surface suspended from the notch part.

* * * * *